US005736303A

United States Patent [19]

McSweeney et al.

[11] Patent Number: 5,736,303

[45] Date of Patent: Apr. 7, 1998

[54] COLOR PHOTOGRAPHIC PAPER WITH REDUCED INTERLAYER EFFECTS

[75] Inventors: Gary John McSweeney, Hilton; Alphonse Dominic Camp, Rochester; Vincent James Flow, Brockport, all of N.Y.

[73] Assignee: Eastman Kodak Company, Rochester, N.Y.

[21] Appl. No.: 657,569

[22] Filed: Jun. 7, 1996

[51] Int. Cl.[6] ..... G03C 7/46

[52] U.S. Cl. ..... 430/380; 430/383; 430/386; 430/387; 430/502; 430/505; 430/551; 430/558; 430/642

[58] Field of Search ..... 430/380, 383, 430/386, 387, 502, 505, 551, 558, 642

[56] References Cited

U.S. PATENT DOCUMENTS

| | | | |
|---|---|---|---|
| 4,277,558 | 7/1981 | Kikuchi et al. | 430/372 |
| 4,782,394 | 11/1988 | Hieda et al. | 350/213.19 |
| 5,006,454 | 4/1991 | Sasaki et al. | 430/546 |
| 5,126,234 | 6/1992 | Naruse et al. | 430/551 |
| 5,208,140 | 5/1993 | Nishijima | 430/551 |
| 5,356,763 | 10/1994 | Takakashi et al. | 430/551 |
| 5,380,632 | 1/1995 | Marsden et al. | 430/642 |
| 5,397,689 | 3/1995 | Ohki et al. | 430/551 |
| 5,405,735 | 4/1995 | Ogawa | 430/505 |
| 5,415,988 | 5/1995 | Ohki et al. | 430/551 |
| 5,464,731 | 11/1995 | Ohki et al. | 430/551 |
| 5,561,036 | 10/1996 | Singer et al. | 430/551 |

FOREIGN PATENT DOCUMENTS

| | | |
|---|---|---|
| 0 286 431 | 10/1988 | European Pat. Off. . |
| 0 319 985 | 6/1989 | European Pat. Off. . |
| 0 361 427 | 4/1990 | European Pat. Off. . |
| 0 384 393 | 8/1990 | European Pat. Off. . |
| 0 391 341 | 10/1990 | European Pat. Off. . |
| 0 457 543 | 11/1991 | European Pat. Off. . |
| 0 477 870 | 4/1992 | European Pat. Off. . |
| 0 515 128 | 11/1992 | European Pat. Off. . |
| 0 692 737 | 7/1994 | European Pat. Off. . |
| 0 638 844 | 8/1994 | European Pat. Off. . |
| 0 697 625 | 8/1994 | European Pat. Off. . |
| 0 628 866 | 12/1994 | European Pat. Off. . |

OTHER PUBLICATIONS

Research Disclosure No. 18716, Nov. 1979, pp. 647–651.
Research Disclosure No. 37038, Feb. 1995, pp. 79–116.

*Primary Examiner*—Geraldine Letscher
*Attorney, Agent, or Firm*—Paul A. Leipold

[57] ABSTRACT

The invention relates to a photographic element comprising at least one layer comprising at least one substituted hydroquinone and adjacent said at least one layer comprising substituted hydroquinone, at least one layer comprising coupler Magenta-1

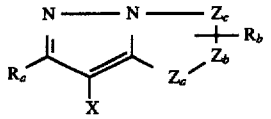

MAGENTA-1 wherein $R_a$ and $R_b$ independently represent H or a substituent; $R_c$ is a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$, wherein the ratio of gelatin to organic component in said layer comprising magenta 1 is greater than 1.1, wherein said at least one layer comprising substituted hydroquinone comprises a ratio of gelatin to organic component is greater than 1.5, and wherein said element comprises a ratio of gelatin to organic component of greater than 1.25.

4 Claims, No Drawings

COLOR PHOTOGRAPHIC PAPER WITH REDUCED INTERLAYER EFFECTS

FIELD OF THE INVENTION

This invention relates to photographic elements. It particularly relates to color photographic papers.

BACKGROUND OF THE INVENTION

The formation of color photographic elements comprising three light sensitive layers comprising cyan, magenta, and yellow couplers is well known. In the formation of such photographic elements, it is known to place scavengers for oxidized developer into non-light sensitive layers between the coupler containing layers in order to provide better color reproduction by preventing oxidized developer from developing dye in unexposed regions. The substituted hydroquinone scavengers have been found to be successful in minimizing movement of oxidized developer. However, it appears that the substituted hydroquinones themselves are subject to movement within the photographic structure under certain conditions. If the substituted hydroquinones migrate into coupler containing layers, then image quality may be deteriorated because of their interfering with the development of coupler by scavenging oxidized developer prior to its reaction with the couplers. The problem of failure to form image dye because of migration of substituted hydroquinones seems to be accentuated with certain magenta couplers. These couplers are generally known as the pyrazoloazoles. Furthermore, it has been shown that substituted hydroquinones can migrate into layers where cyan image dye has formed and interact with the dye to form a leuco-dye species that leads to loss of cyan image density.

PROBLEM TO BE SOLVED BY THE INVENTION

There is a need to provide improved photographic performance by preventing movement of substituted hydroquinones in photographic elements. There is a particular need to prevent movement of the substituted hydroquinone in the interlayer between the magenta coupler containing layer and cyan coupler containing layer.

SUMMARY OF THE INVENTION

An object of the invention is to overcome disadvantages of the prior photographic papers.

A further object of the invention is to provide improved magenta dye density in color papers.

A further object is to provide photographic color papers that exhibit improved handling characteristics, particularly when subjected to pressure treatments both before and after processing.

A further object is to provide improved cyan dye permanence.

A still further object is to lower manufacturing costs.

These and other objects of the invention are generally accomplished by providing a photographic element comprising at least one layer comprising at least one substituted hydroquinone and adjacent said at least one layer comprising substituted hydroquinone, at least one layer comprising Magenta-1 coupler

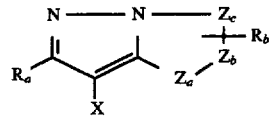

MAGENTA-1 wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$, wherein the ratio of gelatin to organic component in said layer comprising magenta 1 is greater than 1.1, wherein said at least one layer comprising substituted hydroquinone comprises a ratio of gelatin to organic component is greater than 1.5, and wherein said element comprises a ratio of gelatin to organic component of greater than 1.25.

ADVANTAGEOUS EFFECT OF THE INVENTION

An advantageous effect of this invention is that substituted hydroquinone oxidized developer scavengers do not migrate to coupler layers to interfere with dye development. A further advantage is that the magenta dye density is increased. A further advantage is that the photographic element of the invention is less sensitive to mechanical pressure prior to or after exposure to light. Another advantage is that cyan image dye density is not impacted by pressure treatment.

DETAILED DESCRIPTION OF THE INVENTION

The invention photographic element has numerous advantages over prior products. The photographic element of the invention is more stable and provides higher picture quality when subjected to pressure prior to or after exposure to light. The element provides sharp pictures with high magenta density and improved cyan dye permanence. The photographic elements of the invention have improved resistance to fading, particularly for embossed prints. The photographic element provides cost savings by the use of a minimal amount of coupler to form high quality images.

In the invention it has been found that there is a need to provide a certain amount of gelatin in the substituted hydroquinone scavenger containing layers in order to inhibit migration of the substituted hydroquinone scavengers into adjacent coupler containing layers. Further, there is a need to maintain at least a specified amount of gelatin in the coupler containing layers in order to inhibit migration of substituted hydroquinones into the coupler containing layer. In the invention the relationship between the amount of gelatin and organic components has been determined in order to arrive at stable high quality photographic elements. This regulation of gelatin to organic components has been found to be particularly important when the photographic elements contain pyrazoloazole couplers.

The invention may suitably utilize any magenta coupler of the Magenta-1 structure

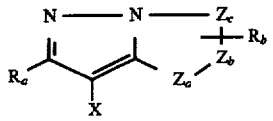

MAGENTA-1 wherein $R_a$ and $R_b$ independently represent H or a substituent selected from an aryl, alkyl, anilino, carbonamido, ureido, carbamoyl, alkoxy, aryloxycarbonyl, alkoxycarbonyl, alkylsulfonyl, or N-heterocyclic group; preferably an alkyl or aryl group substituted with aryl, alkyl, anilino, carbonamido, ureido, carbamoyl, alkoxy, aryloxycarbonyl, alkoxycarbonyl, alkylsulfonyl, or N- heterocyclic group; or more preferably an alkyl group substituted with an alkylsulfonyl group; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

A particularly preferred magenta has been found to be

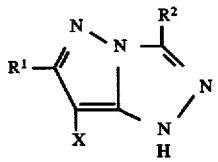

MAGENTA-1a wherein $R^1$ and $R^2$ independently represent alkyl, aryl, and substituted aryl or substituted alkyl where the substituents may be selected from an aryl, alkyl, anilino, carbonamido, ureido, carbamoyl, alkoxy, aryloxycarbonyl, alkoxycarbonyl, alkylsulfonyl, or N-heterocyclic group. Preferably $R^2$ is an alkyl or aryl group substituted with aryl, alkyl, anilino, carbonamido, ureido, carbamoyl, alkoxy, aryloxycarbonyl, alkoxycarbonyl, alkylsulfonyl, or N-heterocyclic group; or more preferably $R^2$ is an alkyl group substituted with alkylsulfonyl group. Preferably $R^1$ is a tertiary alkyl group.

Y is Cl or another group than can be displaced by the oxidize color developer.

A most preferred magenta coupler has been found to be Magenta-2

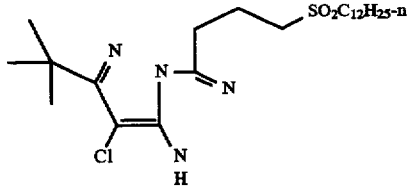

MAGENTA-2 as this magenta coupler provides a particularly desirable color and good image permanence.

Scavengers generally are considered to perform as follows:

Once the developing agent present in the developing solution is oxidized, it couples immediately with the color forming coupler whether or not a silver photographic image is present. Aerial oxidation of the developer or oxidation by means other than production of a silver image therefore can convert the developer to a form which will immediately react with the color forming coupler to produce a color fog or stain. This effect is especially noticeable in reflection print materials that are viewed against a white background. Color fog or stain arising from the above-described causes is not readily controlled by the same procedures used to control silver fog. A further effect is seen in areas of maximum density where large amounts of oxidized developer are formed. In situations where the scavenger fails to perform as desired, the oxidized developer will migrate to a different coupler containing layer and form image dye leading to contamination of the color of maximum density.

The incorporation of hydroquinone or certain of its derivatives for the control of color contamination or fog is well known in the patent literature where such compounds are called antioxidants, antistain agents, or oxidized developer scavengers. The purpose of such antistain agents is to reduce the oxidized form of any of the primary aromatic amine color-developing agents (used in color processes) back to the developing agent or to a form that will not couple with the color-forming coupler. It should also be noted that the antistain agents themselves and any reaction products thereof that might be formed in a color process should not impart any undesired color to the color print. Antistain agents are advantageously coated in any of the layers of the multilayer photographic material. For example, they are added to one or more of the light-sensitive layers and/or in any of the nonlight-sensitive layers coated over or between the light-sensitive layers. It will be appreciated that a layer containing such antistain agents coated between two light-sensitive dye-forming layers will be effective in preventing oxidized color-developing agent formed by development in one light-sensitive layer from diffusing into the second layer and forming unwanted dye in said second layer. Compounds that have been taught as being useful antistain agents in color materials include ballasted or nondiffusing antioxidants or antistain agents, e.g., dihydroxybenzenes having at least one appended group comprising at least about 8 carbon atoms, e.g., didodecylhydroquinones, such as those described in U.S. Pat. Nos. 2,336,327 by Weissberger et al, 2,728,659 by Loria et al, 2,360,290 by Vittum et al, 2,403,721 by Jelley et al, 3,700,453 by Knechel, and 2,701,197 by Thirtle et al, dihydroxynaphthalenes similar to the dihydroxybenzenes described hereinabove, and mixtures thereof. These scavengers for developer oxidation products are dispersed in the binder by conventional means.

The substituted hydroquinone of the invention may be any material that provides the desired scavenging of oxidized developer that leaves a coupler containing layer. The substituted hydroquinones of the invention may be substituted with primary, secondary, and tertiary alkyl groups of carbon length 1–30. Further, these alkyl groups may be substituted with sulfonic acid, carboxylic acid, esters, ketones, and various nitrogen containing derivatives including primary, secondary, and tertiary amines. These substitutions may be in the 2, 3, 5, and 6 positions of 1,4-dihydroxybenzenes. The suitable substituted hydroquinones include 2,5-disubstituted hydroquinones. A preferred substituted hydroquinone has been found to be di-tertiary octylhydroquinone because it provides effective scavenging at a low cost.

The ratio of gelatin to organic components in the magenta image forming layer is greater than 1.1. It is preferred that the ratio not be greater than 2.0 as this would cause problems as an excess amount of water would need to be removed from a photographic element formed with that much gelatin. It further would create a similar problem in development of the photographic element as a greater amount of water would be picked up and would need to be removed during drying.

The scavenging layer contains a ratio of gelatin to organic components of greater than 1.5. For similar reasons described above with respect to the maximum upper limit of the ratio, it is desired that this amount also not be greater than 3.0 in order to prevent excess water removal being required during formation or development.

The ratio of gelatin to organic components in the entire photographic element should be greater than 1.25 in order to provide the improved element of the invention. The upper limit of the ratio would be about 2.0. The upper limit is only limited by the desirability of not being required to remove excessive amounts of water after formation of the photographic element or development of the element.

The element of the invention may be developed using an amplification developing system such as A) A method of forming a photographic image by a redox amplification method from an imagewise exposed photographic silver halide material containing at least one dye image-forming color coupler which comprises treating the material with one of the processing sequences;

DEV then AMP

DEV then DEV/AMP

AMP then DEV

AMP then DEV/AMP wherein DEV means color developer, AMP means amplifier, and DEV/AMP means developer/amplifier, characterized in that the material is treated in at least one of the compositions more than once.

B) A method of forming a photographic image from an imagewise exposed photographic silver halide material by treating the material with a redox amplifying solution comprising a reducing agent and a redox amplification oxidant. Where the reducing agent is a color developing agent and where the oxidant is hydrogen peroxide.

The term "organic component" is defined as including couplers, permanent solvents, auxiliary solvents, scavengers, ultraviolet light absorbers, and stabilizers. "Organic components" do not include silver halide or gelatin.

Solvents of two types are used in preparation of color couplers so that they may be dispersed in gelatin to form color papers. One type of solvent is normally called a permanent solvent. The solvents are high boiling and are not removed after formation of the color paper. Other solvents are called auxiliary solvents and the majority of this solvent is removed by evaporation, washing or dialysis of the dispersion after formation. Typical of permanent solvents useful in the invention are the following:

Tritolyl phosphate

Dibutyl phthalate

N,N-Diethyldodecanamide

N,N-Dibutyldodecanamide

Tris(2-ethylhexyl)phosphate

Acetyl tributyl citrate 2,4-Di-tert-pentylphenol 2-(2-Butoxyethoxy)ethyl acetate 1,4-Cyclohexyldimethylene bis(2-ethylhexanoate)

The dispersions of the invention may also include ultraviolet stabilizers that absorb ultraviolet radiation and contribute to the stability of photographic elements when exposed to light. Typical of such dyes are those disclosed in *Research Disclosure* 36544 at page 514, Section VI, Subsection 1. Examples of UV stabilizers are

UV-9

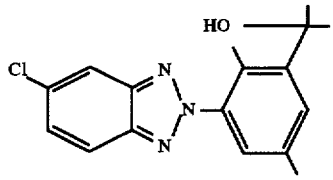

UV-2

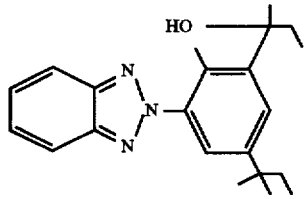

UV-3

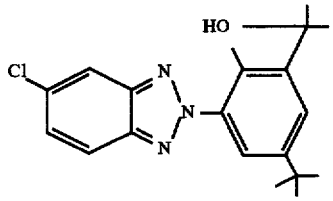

UV-4

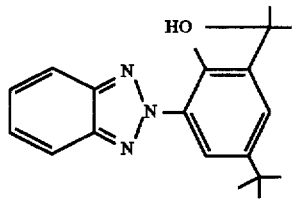

UV-5

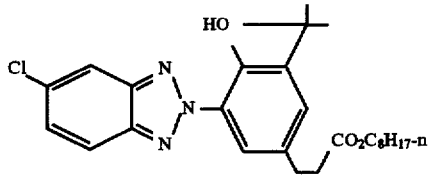

UV-6

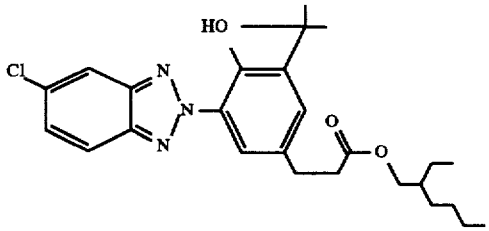

UV-7

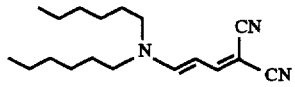

UV-8

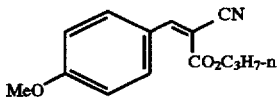

While the magenta couplers for use in the invention have been described, the invention also would contain cyan and yellow couplers in order to complete the three-layer structure. The cyan and magenta couplers may be selected from any suitable materials utilized in color papers. Suitable couplers include those disclosed in *Research Disclosure* 37038 at pages 80–83. Specific preferred couplers are disclosed in the examples that follow.

The color papers of the invention also may include materials typical in color paper such as fog inhibitors, surfactants, hardeners, and filter or absorber dyes. Such materials also are disclosed in *Research Disclosure* 37038 in Sections III, IV, VII, XI, and XII.

In the formation of prints, there is a practice of embossing the prints in order to give them an aged or hand painted appearance. This embossing involves passing the developed print under a pressure roller which embosses the surface. This embossing tends to displace some layers of the print. These displaced layers are particularly susceptible to discoloration. The instant invention by providing the stated ratios of relevant organic components minimizes defects caused by such displacement.

The following examples illustrate the practice of this invention. They are not intended to be exhaustive of all possible variations of the invention. Parts and percentages are by weight unless otherwise indicated.

EXAMPLES

Example 1

A multi-layered light-sensitive material was prepared by forming the layers shown in the following Table 1 on a reflective support. The coating solutions were prepared as shown below and the subjected to a pressure test.

A yellow coupler dispersion was prepared by dissolving yellow coupler Y-1 in a high boiling solvent HBS-1 in proportions shown in table 1 and dispersing this solution in an aqueous gelatin solution containing a polymeric latex ST-1 by means known in the art. This dispersion was then mixed with a blue light-sensitive silver halide emulsion to provide a coating solution for layer 1. Coating solutions for layers 2–7 were prepared similarly to provide sample 1 where the ratio of gelatin to organic components in the green-sensitive layer is 1.0.

Sample 2 was prepared as described in sample 1 except that the components of the blue sensitive layer were changed as shown in Table 2, where Y1 was replaced by Y2, ST-1 was replaced by ST-2, and HBS-4 was added to the blue light sensitive layer. Additionally, while the components of the green light sensitive layer remain unchanged the gelatin to organic components ratio was raised to 1.23.

Sample 3 was prepared as in sample 2 except that the components of the green sensitive layer were replaced by those shown in Table 3 and the ratio of gelatin to organic components in the green light-sensitive layer was 1.0.

Sample 4 was prepared as in sample 3 except that the ratio of gelatin to organic components in the green sensitive layer was raised to 1.23 as shown in Table 4.

DESCRIPTION OF THE PRE-EXPOSURE PRESSURE SENSITIVITY TEST

A pressure sensitivity test was performed by placing an unexposed 35 mm×16" sample of photographic paper, emulsion side up, around a stainless steel round bar having a diameter of 5 mm. The ends of the paper were brought together and a 1000 g weight was attached to the joined ends. The weight was removed after 10 minutes, and a step tablet exposure as was made, followed by RA-4 processing.

The test samples were examined for the formation of green appearing "lines" located in the area of the contact point of the steel rod.

Assessment was made as to the composition of the green appearing coloration (i.e., the result of minus magenta or the result of a plus cyan and yellow dye formation) and to the severity of the lines formed (for the cases of the minus magenta position).

DESCRIPTION OF POST EXPOSURE SENSITIVITY TEST

A 0.5 second neutral step tablet exposure was made to the sample materials. The materials were then processed using RA-4 chemistry.

The samples were placed emulsion side up into the nip of a motor driven embossing device consisting of two 20" wide rollers (one embossing roll, one smooth backing roll) with a 5000 psi load. The roll has a canvas pattern such as used in the Trade to provide a textured surface.

The materials then showed a textured pattern which changed the front surface of the materials.

The materials were then heat treated at 200° F. for 10 seconds. The samples were then examined for its appearance of red marks as shown in Table 5.

Samples 1–4 were subjected to the above pressure sensitivity tests and the results are shown in Table 5.

TABLE 5

| Sample | Magenta coupler | Magenta Gel:organic Component | Interlayer Gel:organic Component | Pre Exposure Pressure Test | Post Exposure Pressure Test | Remarks | Total Pad Gel:organic Component |
|---|---|---|---|---|---|---|---|
| 1 | M-1 | 1.00 | 1.34 | No Green Lines | No mark | Comparison | 1.1 |
| 2 | M-1 | 1.23 | 1.68 | No Green Lines | No mark | Comparison | 1.4 |
| 3 | M-2 | 1.00 | 1.38 | Green Lines | Mark | Comparison | 1.3 |
| 4 | M-2 | 1.23 | 2.11 | No Green Lines | No mark | Invention | 1.4 |

Table 5 shows that magenta coupler M-1 can be used effectively under a wide range of gel:organic component ratios. Coupler M-2 at low ratios of gel:organic components exhibits pressure sensitivity producing photographic prints of unacceptable quality. It is only at the higher levels that no pressure marks are produced.

TABLE 1

| Sample 1 | |
|---|---|
| Layer 1 | |
| gel | 1.420 |
| silver | 0.218 |
| Y-1 | 0.450 |
| ST-1 | 1.500 |
| HBS-1 | 0.307 |
| Layer 2 | |
| gel | 0.700 |

TABLE 1-continued

| Sample 1 | |
|---|---|
| SC-1 | 0.061 |
| HBS-1 | 0.175 |
| HBS-2 | 0.009 |
| Layer 3 | |
| gel | 1.170 |
| silver | 0.185 |
| M-1 | 0.393 |
| HBS-3 | 0.380 |
| HBS-4 | 0.064 |
| ST-2 | 0.304 |
| SC-1 | 0.004 |
| Layer 4 | |
| gel | 0.512 |
| UV-1 | 0.250 |
| SC-1 | 0.003 |
| HBS-5 | 0.008 |
| Layer 5 | |
| gel | 1.290 |
| silver | 0.205 |
| C-1 | 0.393 |
| HBS-1 | 0.385 |
| UV-2 | 0.253 |
| HBS-4 | 0.032 |
| SC-1 | 0.003 |
| Layer 6 | |
| gel | 0.402 |
| UV-1 | 0.196 |
| SC-1 | 0.040 |
| HBS-5 | 0.066 |
| Layer 7 | |
| gel | 0.75 |
| SC-1 | 0.012 |
| HBS-1 | 0.002 |

TABLE 2

| Sample 2 | |
|---|---|
| Layer 1 | |
| gel | 1.400 |
| silver | 0.191 |
| Y-2 | 1.000 |
| ST-6 | 0.240 |
| HBS-1 | 0.330 |
| HBS-4 | 0.280 |
| Layer 2 | |
| gel | 0.700 |
| SC-1 | 0.061 |
| HBS-1 | 0.175 |
| HBS-2 | 0.009 |
| Layer 3 | |
| gel | 1.150 |
| silver | 0.209 |
| M-1 | 0.393 |
| HBS-3 | 0.130 |
| HBS-4 | 0.064 |
| ST-2 | 0.304 |
| SC-1 | 0.004 |
| Layer 4 | |
| gel | 0.580 |
| UV-1 | 0.224 |
| SC-1 | 0.046 |
| HBS-5 | 0.074 |

TABLE 2-continued

| Sample 2 | |
|---|---|
| Layer 5 | |
| gel | 1.320 |
| silver | 0.227 |
| C-1 | 0.393 |
| HBS-1 | 0.385 |
| UV-2 | 0.253 |
| HBS-4 | 0.032 |
| SC-1 | 0.003 |
| Layer 6 | |
| gel | 0.580 |
| UV-1 | 0.224 |
| SC-1 | 0.046 |
| HBS-5 | 0.075 |
| Layer 7 | |
| gel | 1.000 |
| SC-1 | 0.012 |
| HBS-1 | 0.036 |

TABLE 3

| Sample 3 | |
|---|---|
| Layer 1 | |
| gel | 1.507 |
| silver | 0.263 |
| Y-2 | 1.076 |
| ST-6 | 0.258 |
| HBS-1 | 0.355 |
| HBS-4 | 0.301 |
| Layer 2 | |
| gel | 0.753 |
| SC-1 | 0.066 |
| HBS-1 | 0.188 |
| HBS-2 | 0.065 |
| Layer 3 | |
| gel | 1.238 |
| silver | 0.123 |
| M-2 | 0.356 |
| HBS-3 | 0.319 |
| HBS-4 | 0.037 |
| ST-3 | 0.138 |
| ST-4 | 0.138 |
| ST-5 | 0.238 |
| Layer 4 | |
| gel | 0.738 |
| UV-1 | 0.295 |
| SC-1 | 0.071 |
| HBS-5 | 0.116 |
| Layer 5 | |
| gel | 1.432 |
| silver | 0.254 |
| C-1 | 0.423 |
| HBS-1 | 0.419 |
| UV-2 | 0.272 |
| HBS-4 | 0.035 |
| SC-1 | 0.005 |
| Layer 6 | |
| gel | 0.510 |
| UV-1 | 0.205 |
| SC-1 | 0.049 |
| HBS-5 | 0.080 |
| Layer 7 | |
| gel | 1.000 |

TABLE 3-continued

| Sample 3 | |
|---|---|
| SC-1 | 0.012 |
| HBS-1 | 0.036 |

TABLE 4

| Sample 4 | |
|---|---|
| **Layer 1** | |
| gel | 1.507 |
| silver | 0.263 |
| Y-2 | 1.076 |
| ST-6 | 0.258 |
| HBS-1 | 0.355 |
| HBS-4 | 0.301 |
| **Layer 2** | |
| gel | 0.753 |
| SC-1 | 0.066 |
| HBS-1 | 0.188 |
| HBS-2 | 0.065 |
| **Layer 3** | |
| gel | 1.238 |
| silver | 0.123 |
| M-2 | 0.291 |
| HBS-1 | 0.261 |
| HBS-2 | 0.030 |
| ST-3 | 0.113 |
| ST-4 | 0.113 |
| ST-5 | 0.195 |
| **Layer 4** | |
| gel | 0.738 |
| UV-1 | 0.220 |
| SC-1 | 0.055 |
| HBS-5 | 0.037 |
| HBS-1 | 0.037 |
| **Layer 5** | |
| gel | 1.432 |
| silver | 0.254 |
| C-1 | 0.423 |
| HBS-1 | 0.419 |
| UV-2 | 0.272 |
| HBS-4 | 0.035 |
| SC-1 | 0.005 |
| **Layer 6** | |
| gel | 0.510 |
| UV-1 | 0.153 |
| SC-1 | 0.038 |
| HBS-5 | 0.026 |
| HBS-1 | 0.026 |
| **Layer 7** | |
| gel | 1.076 |
| SC-1 | 0.013 |
| HBS-1 | 0.039 |

APPENDIX

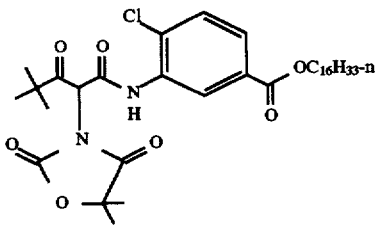

(Y-1)

-continued

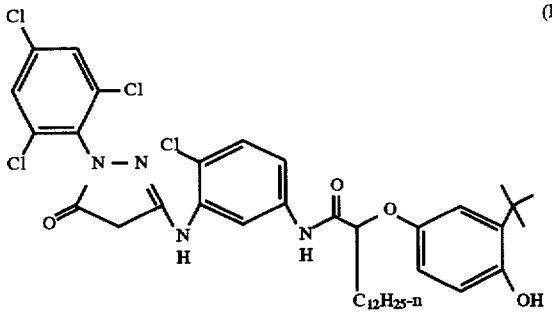

(M-1)

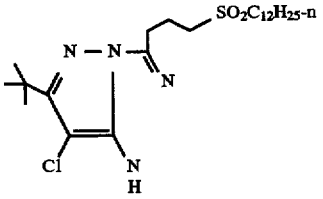

(M-2)

Dibutyl phthalate (HBS-1)

Irganox 1076 (HBS-2)

Tris (2-ethylhexyl) phosphate (HBS-3)

2-(2-butoxyethoxyethyl) acetate (HBS-4)

1, 4-Cyclohexylenedimethylene bis (2-ethylhexanoate) (HBS-5)

6:1

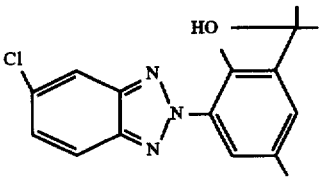

UV-1

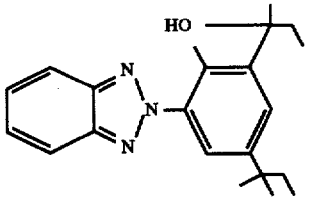

(UV-2)

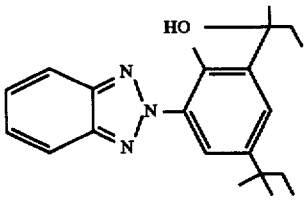

(C-1)

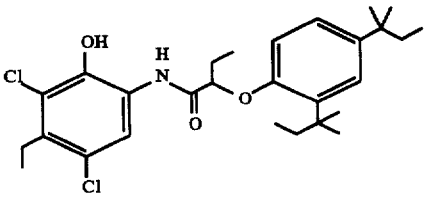

-continued (Y-2)

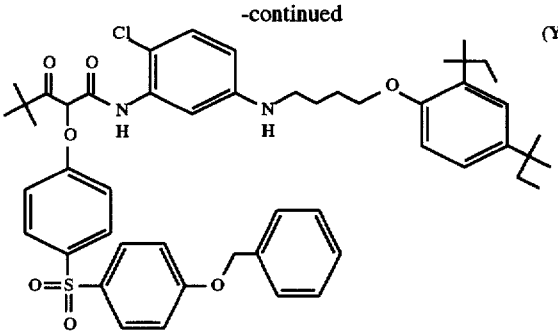

SC-1

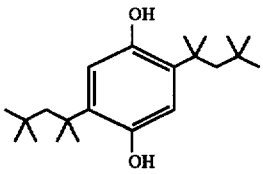

(ST-1)

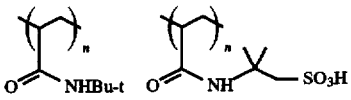

(99:1) mw = 75-80,000

(ST-2)

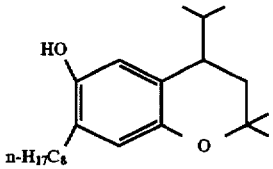

(ST-3)

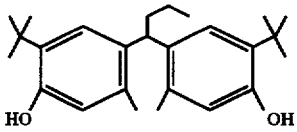

(ST-4)

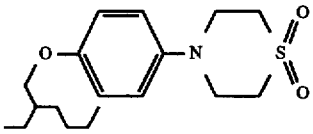

(ST-5)

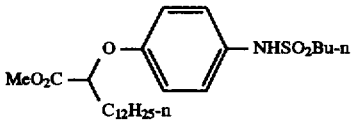

(ST-6)

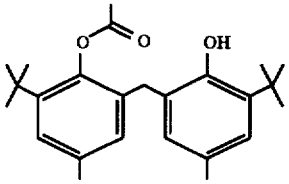

The invention has been described in detail with particular reference to preferred embodiments thereof, but it will be understood that variations and modifications can be effected within the spirit and scope of the invention.

We claim:

1. A photographic element comprising at least one layer comprising at least one substituted hydroquinone and adjacent said at least one layer comprising substituted hydroquinone, at least one layer comprising dibutyl phthalate and Magenta Coupler 2

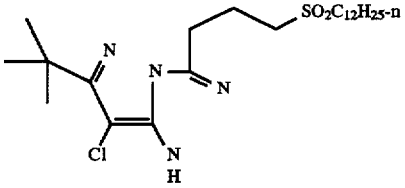

MAGENTA-2 wherein the ratio of gelatin to organic component in said layer comprising magenta 2 is between 1.1 and 2.0, wherein said at least one layer comprising substituted hydroquinone comprises a ratio of gelatin to organic component is between 1.5 and 3, wherein said element comprises a ratio of gelatin to organic component of between 1.25 and 2.0, wherein dibutyl phthalate to coupler in said at least one layer comprising Magenta-2 coupler have a ratio of between 0.5 and 1.5, and wherein said hydroquinone comprises ditertiary octyl hydroquinone in an amount of between 0.1 and 0.4 $g/m^2$.

2. The element of claim 1 wherein an ultraviolet light absorber is present in an amount of between 0.4 and 1.0 $g/m^2$.

3. A method of forming a photographic image comprising providing a photographic element comprising at least one layer comprising at least one substituted hydroquinone and adjacent said at least one layer comprising substituted hydroquinone, at least one layer comprising dibutyl phthalate and Magenta Coupler 2

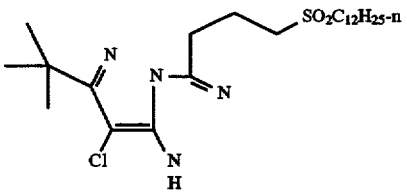

MAGENTA-2 wherein the ratio of gelatin to organic component in said layer comprising magenta 2 between 1.1 and 2.0, wherein said at least one layer comprising substituted hydroquinone comprises a ratio of gelatin to organic component is between 1.5 and 3, wherein said element comprises a ratio of gelatin to organic component of between 1.25 and 2.0, exposing said element and developing said element utilizing a developer that comprises an amplification system, wherein dibutyl phthalate to coupler in said at least one layer comprising Magenta-2 coupler halve a ratio of between 0.5 and 1.5, and wherein said hydroquinone comprises ditertiary octyl hydroquinone in an amount of between 0.1 and 0.4 $g/m^2$.

4. The method of claim 3 wherein an ultraviolet light absorber is present in an amount of between 0.4 and 1.0 $g/m^2$.

* * * * *